US009945401B2

(12) United States Patent
Huseman et al.

(10) Patent No.: US 9,945,401 B2
(45) Date of Patent: Apr. 17, 2018

(54) FAILSAFE SYSTEM AND METHOD FOR REDUCING LOAD IN A HYDRAULIC CYLINDER

(71) Applicant: Hydril USA Distribution, LLC, Houston, TX (US)

(72) Inventors: Joseph Edison Huseman, Houston, TX (US); Eric Dale Larson, Houston, TX (US); Jamie Clay Gamble, Houston, TX (US); Wayne Harvey, Houston, TX (US); Alexander McAuley, Houston, TX (US); Juan Pedro Trevino, Houston, TX (US)

(73) Assignee: HYDRIL USA DISTRIBUTION, LLC, Houston, TX (US)

( * ) Notice: Subject to any disclaimer, the term of this patent is extended or adjusted under 35 U.S.C. 154(b) by 126 days.

(21) Appl. No.: 14/941,259

(22) Filed: Nov. 13, 2015

(65) Prior Publication Data

US 2017/0138377 A1 May 18, 2017

(51) Int. Cl.
*F15B 15/14* (2006.01)
*F15B 15/22* (2006.01)

(52) U.S. Cl.
CPC ..... *F15B 15/1471* (2013.01); *F15B 15/226* (2013.01); *F15B 15/1476* (2013.01); *F15B 2211/8752* (2013.01)

(58) Field of Classification Search
CPC ..... F15B 15/1471; F15B 15/226; F15B 15/1476; F15B 2211/8752
USPC ..... 92/443, 85 A, 130 R
See application file for complete search history.

(56) References Cited

U.S. PATENT DOCUMENTS

| | | | | |
|---|---|---|---|---|
| RE30,115 | E | 10/1979 | Herd | |
| 6,079,725 | A * | 6/2000 | Lazaros | A61G 5/08 188/301 |
| 6,487,960 | B1 * | 12/2002 | Chatufale | F15B 13/10 92/13.6 |
| 6,767,165 | B1 | 7/2004 | Corbetta | |

* cited by examiner

*Primary Examiner* — F. Daniel Lopez
*Assistant Examiner* — Daniel Collins
(74) *Attorney, Agent, or Firm* — Hogan Lovells US LLP

(57) ABSTRACT

A mechanism to reduce load of a hydraulic cylinder having a body, a stem movable within the body, and a piston rod connected to the stem. The mechanism includes a mechanism body attached to the body and defining a recess, and a retainer attached to the mechanism adjacent the opening of the recess so that the retainer substantially fills the opening of the recess, and having an aperture that receives an end of the piston rod. The mechanism further includes a cap attached to the piston rod of the hydraulic cylinder within the recess, the cap having a diameter greater than the diameter of the aperture in the retainer, and a spring connected to the cap at a first end and to the retainer at a second end so that as the piston rod moves relative to the failsafe mechanism body, to reduce load transfer between the piston rod and the cylinder body.

20 Claims, 8 Drawing Sheets

FAILSAFE SYSTEM AND METHOD FOR REDUCING LOAD IN A HYDRAULIC CYLINDER

BACKGROUND OF THE INVENTION

1. Field of the Invention

Embodiments disclosed herein relate generally to running tools for use in oil field applications. In particular, embodiments disclosed herein relate to running tools for use in subsea drilling operations.

2. Brief Description of Related Art

Drilling systems are often employed in subsea oil and gas exploration. Such systems include a wide variety of subsea equipment, including tooling used to operate and service such equipment. Such tooling can include hydraulic tools having components, such as hydraulic cylinders, and can be exposed to harsh conditions such as hang-off loads and/or bending loads. Such loads can expose a running tool's components, including hydraulic cylinders and piston rods to tension, compression, high pressure, and bending stresses. Furthermore, user error, or improper attachment of tools to subsea equipment, can lead to increased load stress in the piston rods of hydraulic cylinders and other components. The increased load stress can be caused by tension, compression, and bending forces.

SUMMARY OF THE INVENTION

One aspect of the present technology provides a failsafe mechanism to reduce load of a hydraulic cylinder having a cylinder body, a stem at least partially circumscribed by the cylinder body and movable within the cylinder body, and a piston rod connected to the stem. The mechanism includes a failsafe mechanism body fixedly attached to the cylinder body and defining a recess, a retainer fixedly attached to the failsafe mechanism adjacent the opening of the recess so that the retainer substantially fills the opening of the recess, and having an aperture that receives an end of the piston rod, and a cap attached to the piston rod of the hydraulic cylinder within the recess in the failsafe mechanism body, the cap having a diameter greater than the diameter of the aperture in the retainer so that the cap is retained within the recess by the retainer. The mechanism further includes a spring connected to the cap at a first end and to the retainer at a second end so that as the stem and piston rod move away from the failsafe mechanism body, the spring compresses to reduce load transfer between the piston rod and the cylinder body.

Another aspect of the present technology provides a failsafe mechanism to reduce load transfer of a hydraulic cylinder having a piston rod and a stem, the stem defining a recess adapted to receive the mechanism. The mechanism includes a retainer fixedly attached to the stem of the hydraulic cylinder adjacent the opening of the recess so that the retainer substantially fills the opening of the recess, and having an aperture that receives an end of the piston rod, and a cap attached to the piston rod of the hydraulic cylinder within the recess in the stem, the cap having a diameter greater than the diameter of the aperture in the retainer so that the cap is retained within the recess by the retainer. The mechanism also includes a spring connected to the cap at a first end and to the retainer at a second end so that as the stem and retainer move, the spring extends or compresses to reduce load transfer from the stem to the piston rod.

Yet another aspect of the present technology provides a method of reducing the transfer of a load a piston rod and a cylinder body of a hydraulic cylinder. The method includes the steps of providing a failsafe mechanism body defining a recess and fixedly attached to a cylinder body of a hydraulic cylinder, and a retainer fixedly attached to failsafe mechanism body adjacent the opening of the recess so that the retainer substantially fills the opening of the recess, the retainer having an aperture through the retainer into the recess, and retaining the end of the piston rod within the recess in the stem by attachment of a cap with a greater diameter than the aperture in the retainer to the piston rod within the recess. The method further includes the steps of damping the relative movement between the cylinder body and the piston rod with a spring attached at a first end to the cap and at a second end to the retainer, the spring adapted to compress as the stem moves to reduce load transfer between the cylinder body and the piston rod.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE PREFERRED EMBODIMENT

Figure 1:
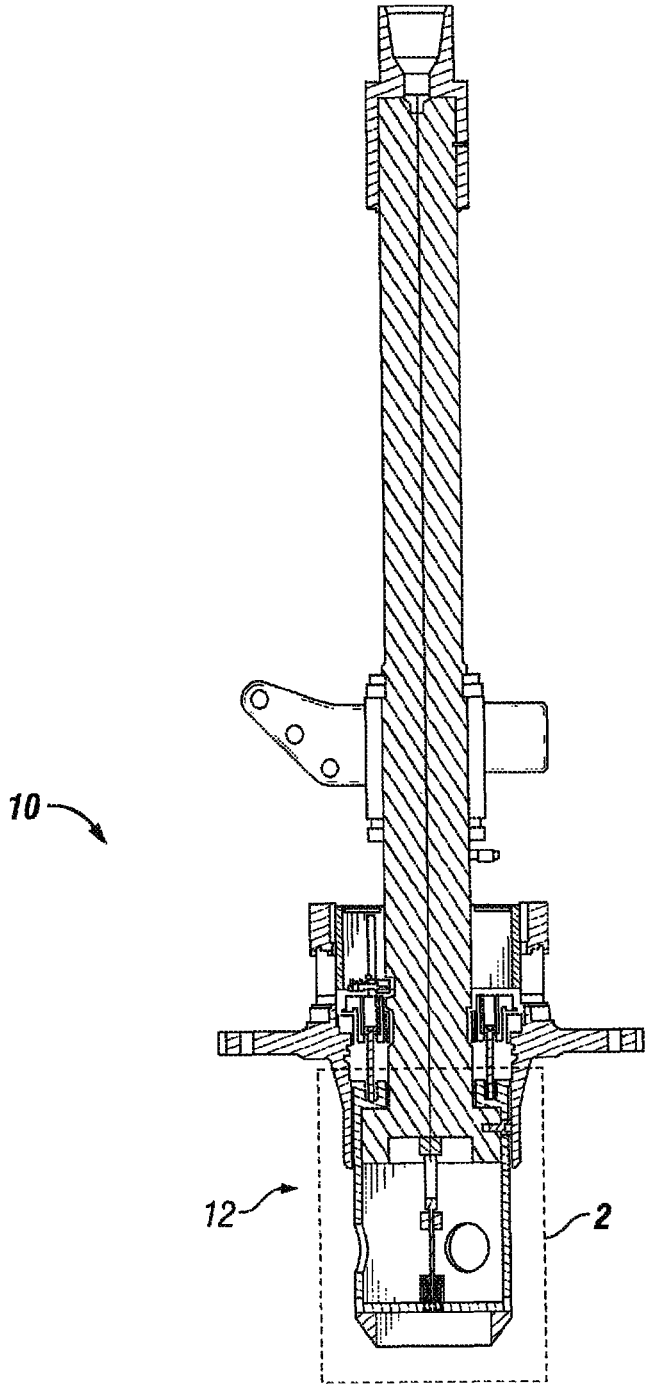
FIG. 1 depicts a hydraulic cylinder in a running tool in accordance with an embodiment of the present technology.

The foregoing aspects, features, and advantages of the present technology will be further appreciated when considered with reference to the following description of preferred embodiments and accompanying drawings, wherein like reference numerals represent like elements. The following is directed to various exemplary embodiments of the disclosure. The embodiments disclosed should not be interpreted, or otherwise used, as limiting the scope of the disclosure, including the claims. In addition, those having ordinary skill in the art will appreciate that the following description has broad application, and the discussion of any embodiment is meant only to be exemplary of that embodiment, and not intended to suggest that the scope of the disclosure, including the claims, is limited to that embodiment.

In FIG. 1, there is shown an embodiment of a running tool 10 having a hydraulic cylinder 12. In one embodiment, the hydraulic cylinder 12 can be employed in a drilling riser in order to support a riser string and blow out preventer (BOP) from a drillship or platform until it can be connected to the wellhead connector on the surface of the sea.

In another embodiment, the hydraulic cylinder 12 can be employed in a well access system, connecting the top tensioned riser to the subsea wellhead. Such a well access system may include a hydraulic cylinder, and may be utilized, for example, by a direct vertical access (DVA) system, a completion workover riser (CWOR) system, a riserless light well intervention (RLWI) system, a gate spider, or the like.

In yet another embodiment, the hydraulic cylinder can be employed in a wellhead connection, such as a connection associated with a stress joint of a connector assembly that engages in the upper rim of the wellhead housing. Hydraulic cylinder 12 can also be employed, for example, in jack-up rigs, spars, drillships, dynamically positioned floating drilling systems, and moored floating drilling systems. A running tool 10 that implements hydraulic cylinder 12 may alternatively be employed in a drill string, for example, a tool joint, a drill collar, a telescoping joint, a riser joint, a riser joint with buoyancy, a fill-up valve, or a termination spool.

In yet another embodiment, the hydraulic cylinder 12 can be utilized in applications other than in running tool 10, including but not limited to, construction equipment, manufacturing machinery, excavators, machine linkages, and wheel bulldozers. The hydraulic cylinder 12 may be used in a hydraulic actuator application, including but not limited to, an aerial work platform, a crane, an earth moving machine, a wind mill, and in solar tracking equipment.

Figure 2:
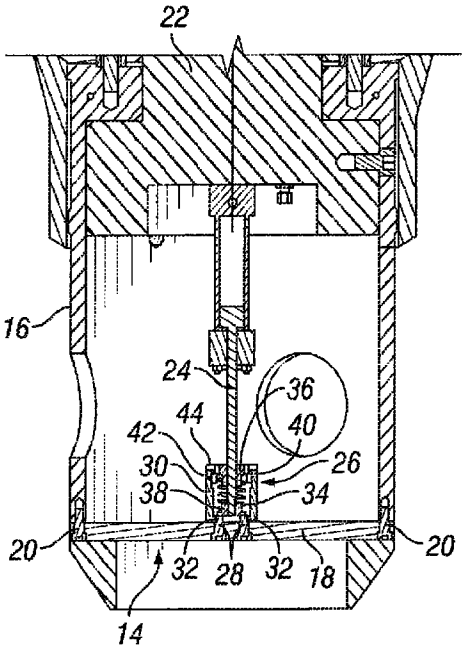
FIG. 2 depicts an enlarged cross-sectional view of the hydraulic cylinder of FIG. 1 as indicated by area 2 of FIG. 1.

In FIG. 2, there is shown a cross-sectional view of one embodiment of the present technology. FIG. 2 depicts certain features of the hydraulic cylinder 12 that are helpful to an accurate description of the embodiments of the invention, including the cylinder housing 14. The cylinder housing 14 includes a cylindrical portion 16 and an end portion 18. The end portion 18 can be attached to the cylindrical portion 16 by fasteners 20, or the cylindrical portion 16 and end portion 18 can be integrally formed. The hydraulic cylinder 12 also includes a stem 22, a piston rod 24, and a failsafe mechanism 26. As used herein, the term piston rod can be any component where high stresses can occur due to tension, compression, and/or bending, including, but not limited to, piston rods of hydraulic cylinders.

In the embodiment depicted in FIG. 2, the failsafe mechanism 26 is shown attached to the end portion 18 of the cylinder housing 14. The failsafe mechanism 26 can be attached to the hydraulic cylinder 12 with an attachment device, which, in the embodiment of FIG. 2, includes fasteners 28, which may include, for example, bolts, fasteners, screws, pipe plugs, rivets, pins, or wingnuts. Alternatively, the failsafe mechanism 26 may be attached to the hydraulic cylinder using a threaded interface.

In the embodiment of FIG. 2, the failsafe mechanism 26 includes a failsafe mechanism body 30. The failsafe mechanism body 30 includes apertures 32 for accepting the fasteners 28, thereby allowing attachment of the failsafe mechanism body 30 to the cylinder body 14. In other embodiments, however, the failsafe mechanism body 30 can be attached to the cylinder body 14 in any appropriate way. The failsafe mechanism body 30 is hollow, defining a recess 34. The failsafe mechanism 26 can be positioned so that the piston rod 24, which is attached to the stem 22 at one end, extends into the recess 34 of the failsafe mechanism body 30.

Figure 3:
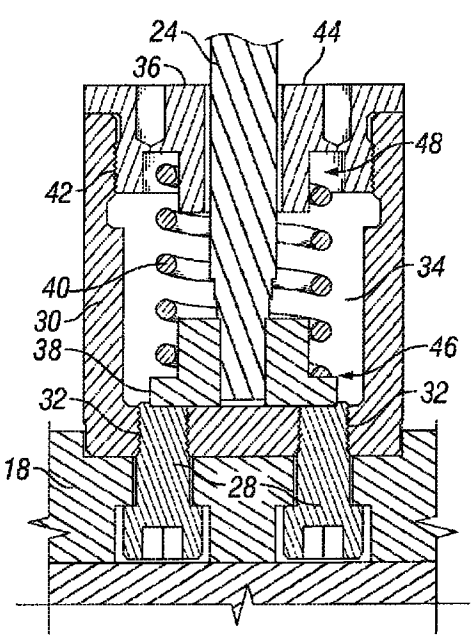
FIG. 3 depicts an enlarged cross-sectional view of the failsafe mechanism of FIGS. 1 and 2.

As shown in greater detail in FIG. 3, the failsafe mechanism 26 can include a retainer 36, a cap 38, and a spring 40. One purpose of the failsafe mechanism 26, as described in greater detail below, is to dampen movement of the piston rod 24 relative to the cylinder body 14 and to reduce the load transferred between the piston rod 24 and the cylinder body 14 when the piston rod 24 moves in the cylinder housing 14. The retainer 36 can be fixedly attached to the failsafe mechanism body 30, and can be attached to the failsafe mechanism body 30, such as by threads at a threaded interface 42. Furthermore, the retainer 36 may have a retainer aperture 44 for receiving an end of piston rod 24.

The cap 38 is positioned in the recess 34 of the failsafe mechanism body 30, and attaches to the end of the piston rod 24 within the recess 34. The cap 38 can be attached to piston rod 34 by a threaded mechanism, which may include, but is not limited to, a threaded insert. Alternatively, the cap 38 can be threaded directly to the piston rod 24. The cap 38 can have a diameter greater than the diameter of the aperture 44 in the retainer 36 so that the cap 38 is retained within the recess 34 by the retainer 36.

In the embodiment shown in FIGS. 2 and 3, the spring 40 is a compression spring or a tension spring, and can be substantially axially aligned with the failsafe mechanism body 30 and the piston rod 24. The spring 40 can be positioned between the cap 38 at a first end 46 of the spring 40, and the retainer 36 at a second end 48 of the spring 40. The spring 40 can be compressed between the cap 38 and the retainer 36 since the diameter of the cap 38 and the diameter of the retainer 36 is larger than the diameter of the spring 40.

Figure 5:
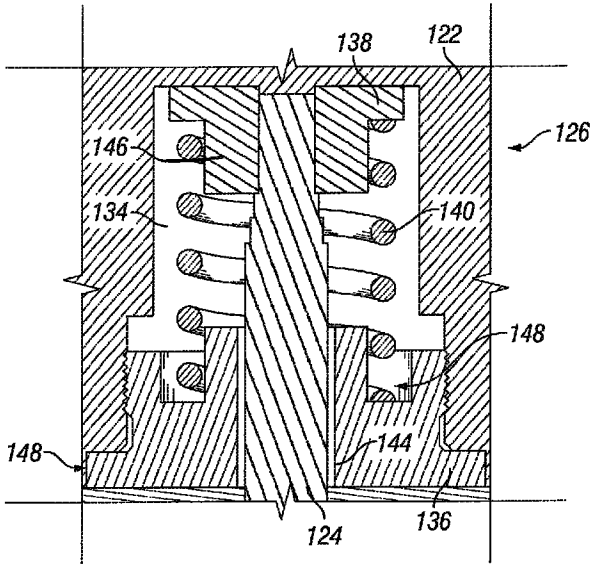
FIG. 5 depicts an enlarged cross-sectional view of the failsafe mechanism of FIG. 4.
Figure 4:
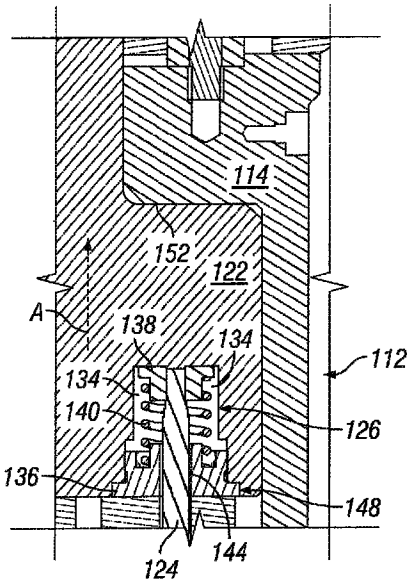
FIG. 4 depicts an alternate embodiment of the failsafe mechanism according to an embodiment of the present technology.

Referring now to FIGS. 4 and 5, there is shown an alternate embodiment of the technology. Similar to the above-described embodiment, FIGS. 4 and 5 show a hydraulic cylinder 112 in tension (a portion of the hydraulic cylinder 112 is shown in FIG. 4). FIG. 4 depicts certain features of the hydraulic cylinder 112, including the cylinder housing 114. The hydraulic cylinder 112 also includes a stem 122, a piston rod 124, and a failsafe mechanism 126. The stem 122 can include a stem recess 134 adapted to receive the failsafe mechanism 126. The stem 122, which is attached to the retainer 136, is shown in FIG. 4 as moving away from the piston 124, as indicated by arrow A.

The failsafe mechanism 126 can further include a retainer 136, a cap 138, and a spring 140. One purpose of the failsafe mechanism 126, as described in greater detail below, is to dampen movement of the stem 122 relative to the piston rod 124 and to reduce the load transferred from the stem 122 to the piston rod 124 when the stem 122 moves in the cylinder body 114. The retainer 136 can be fixedly attached to the stem 122 of the hydraulic cylinder 112 and positioned adjacent an opening 148 in the stem recess 134 so that the retainer 136 substantially fills the recess opening 148. Furthermore, the retainer 136 can have an aperture 144 for receiving the end of the piston rod 124.

Cap 138 is positioned in recess 134 and attaches to the end of the piston rod 124 within the recess 134. The cap 138 can be attached to piston rod 134 by a threaded mechanism, which may include, but is not limited to, a threaded insert. Alternatively, the cap 138 can be threaded directly to the piston rod 124. The cap 138 can have a diameter greater than the diameter of aperture 144 in retainer 148 so that the cap 138 is retained within the stem recess 134 by the retainer 136.

In some embodiments, the spring 140 can be a compression spring or a tension spring, and can be substantially axially aligned with the stem 122. The spring 140 can be positioned between the cap 138 at a first end 146 of the spring 140 and the retainer 136 at a second end 148 of the spring 140. The spring 140 can be compressed between the cap 138 and the retainer 136 since the diameter of the cap 138 and the diameter of the retainer 136 is larger than the diameter of the spring 140. The spring 140 can be positioned between the cap 138 and the retainer 136.

One advantage of this embodiment of the present technology is that the failsafe mechanism 126 redirects the load path from the piston rod 124 to a contact point 152, which may be a contact load shoulder, on the hydraulic cylinder 112. The contact point 152 can be a point of contact between an inner surface of cylinder body 114 and an outer surface of stem 122 as shown, for example, in FIG. 4. The failsafe mechanism 126 can help to ensure that spring 140 deforms sufficiently before a cross section of the stem is plastically deformed. Thus, for example, the failsafe mechanism 126 can redirect the load path, and in doing so, enable greater movement of elements within the hydraulic cylinder 112, than without the presence of failsafe mechanism 126.

Figure 7:
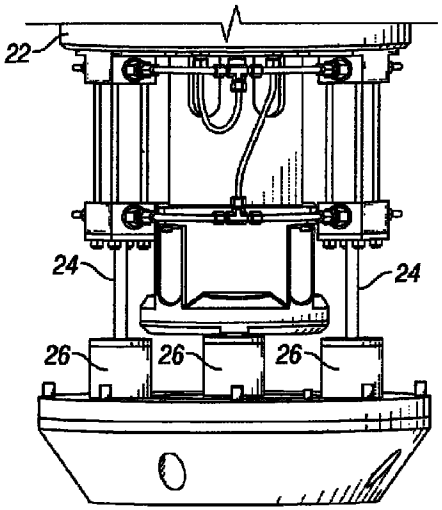
FIG. 7 depicts a side view of a portion of a hydraulic cylinder according to an embodiment of the present technology with multiple failsafe mechanisms positioned in the hydraulic cylinder.
Figure 6:
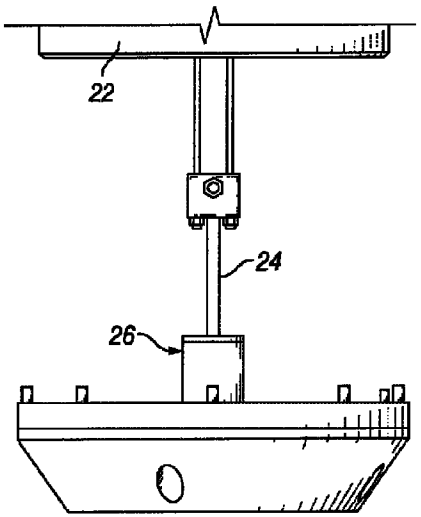
FIG. 6 depicts a side view of a portion of a hydraulic cylinder according to an embodiment of the present technology with a failsafe mechanism positioned in the center of the hydraulic cylinder.

As shown in FIGS. 6 and 7, the failsafe mechanism 26 can be positioned within the hydraulic cylinder in any appropriate configuration. For example, in the embodiment shown in FIG. 6, the failsafe mechanism 26 is positioned substantially coaxial with the stem 22. This embodiment is substantially similar to those shown in d described in reference to FIGS. 1 and 2. Conversely, in the embodiment shown in FIG. 7, a plurality of failsafe mechanisms 26 are positioned around the periphery of the stem 22. Of course, the number and positioning of the failsafe mechanisms within a hydraulic cylinder can vary according to the specific geometry and use of the cylinder, and the configurations depicted in the attached figures only represent exemplary embodiments.

Figure 8:
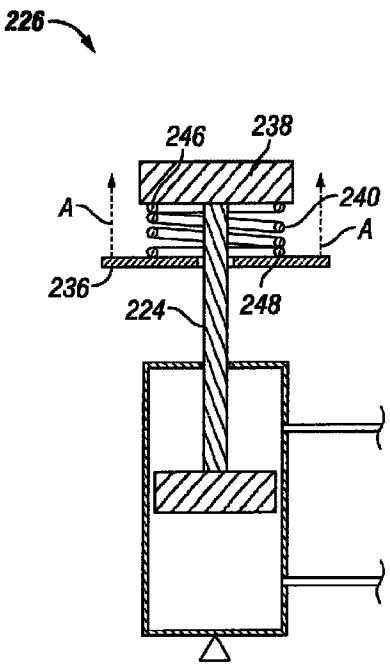
FIG. 8 is a schematic diagram depicting forces acting on components of a hydraulic cylinder of an embodiment of the present technology.

In FIG. 8, there is shown a schematic depicting the failsafe mechanism 226 acting to protect the piston rod 224 from tensile forces that may be transferred to the piston rod 224. FIG. 8 depicts components of the failsafe mechanism 226, including the spring 240, the cap 238, and the retainer 236. Also shown is a schematic representation of the piston rod 224. As shown, the spring 240 can be attached to the cap 238 at the first end 246 of the spring 240, and to the retainer 236 at second end 248 of the spring 240, so that as the retainer 248 moves away from the piston rod 224, the spring 240 compresses. This schematic shows the configuration where the retainer 236 is moving away from the piston rod 224, as indicated by arrows A, thereby compressing the spring 240. Although a single spring 240 is shown, a plurality of the springs 240 may be used in the failsafe mechanism 226 if desired.

Figure 9:
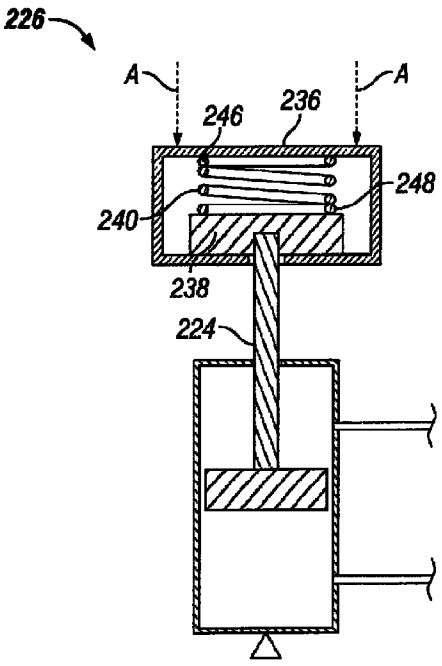
FIG. 9 is a schematic diagram depicting of forces acting on components of a hydraulic cylinder of an alternate embodiment of the present technology.

In FIG. 9, there is shown a schematic depicting the failsafe mechanism 226 acting to protect the piston rod 224 from compressive forces that may be transferred to the piston rod 224. FIG. 9 depicts components of the failsafe mechanism 226, including the spring 240, the cap 238, and the retainer 236. As shown, the retainer 236 can be attached to the spring 240 at the first end 246 of the spring 240, and the cap 238 can be attached to the second end 248 of the spring, so that as retainer 236 moves toward the piston rod 224 in the direction of arrows A, the spring 240 compresses. Although a single spring is shown, a plurality of the springs may be used in the failsafe mechanism if desired.

Figure 10:
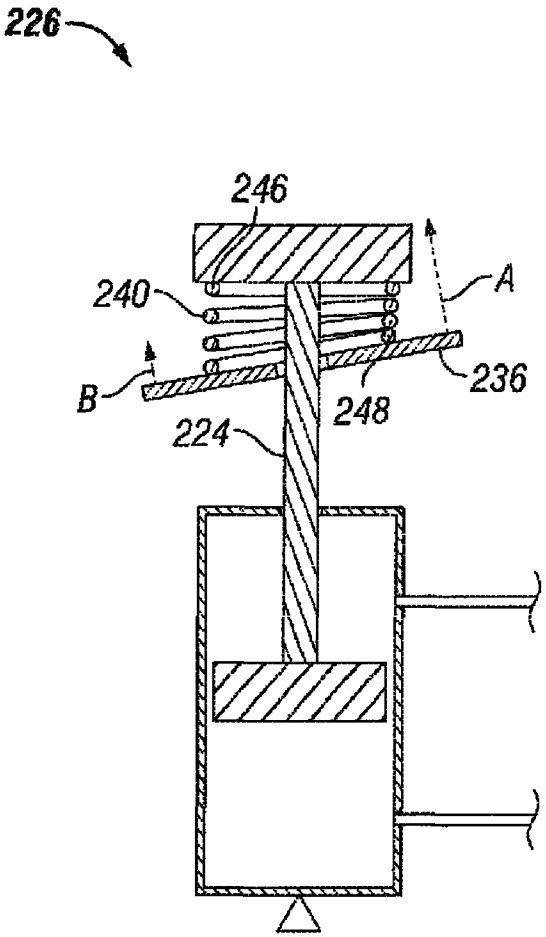
FIG. 10 is a schematic diagram depicting forces acting on components of a hydraulic cylinder of an another alternate embodiment of the present technology.

In FIG. 10, there is shown a schematic of the use of the failsafe mechanism 226 to reduce a transfer of bending forces into the piston rod 224. FIG. 10 depicts components of the failsafe mechanism 226, including the spring 240, the retainer 236, and the cap 238. Also shown is a schematic representation of the piston rod 224. As shown, the spring 240 can be attached to the cap 248 at the first end 246 of the spring 240 and to the retainer 236 at second end 248 of the spring 240. Thus configured, as the retainer 248 moves away from the piston rod 224, the spring 240 compresses, and as the retainer 248 moves toward the piston rod, the spring 240 decompresses. In the schematic of FIG. 10, a first force A is applied to one side of the retainer 236, which a second smaller force B is applied to the opposite side of the retainer 236. This schematic is illustrative of the situation where an uneven force is applied to the retainer 236 which, in the absence of the spring 240 could transfer a bending moment to the piston rod 224. With the failsafe mechanism 236, however, one side of the spring 240 compresses while the other expands in order to absorb a portion of the bending load, thereby preventing the transfer of a portion of the load to the piston rod 224. Although, the above-description contemplates the use of a single spring 240 to both compresses and expands, some embodiments could use two or more separate springs 240 positioned on different sides of the piston rod 224 to achieve the same result.

Figure 11:
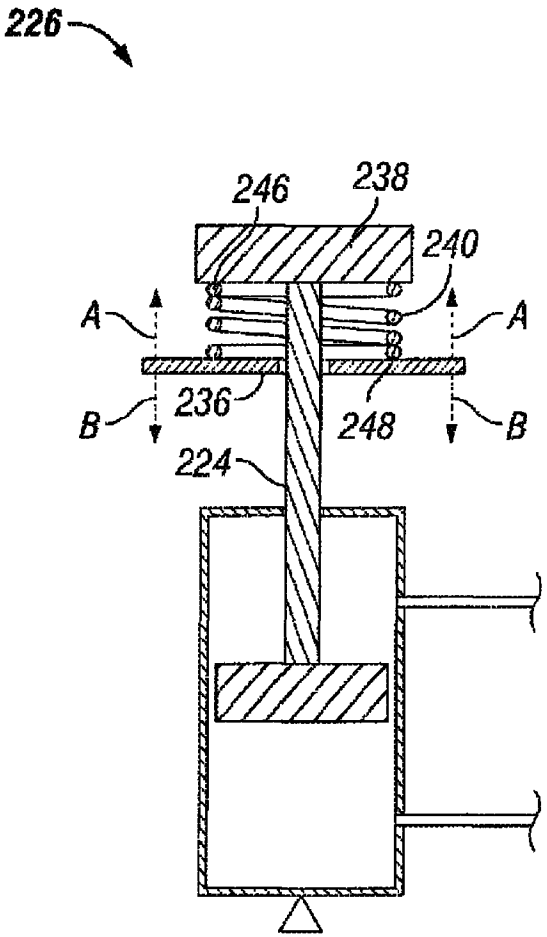
FIG. 11 is a schematic diagram depicting forces acting on components of a hydraulic cylinder of an yet another alternate embodiment of the present technology.

In FIG. 11, there is shown a schematic depicting the failsafe mechanism 226 acting to protect the piston rod 224 from cyclical tensile and compressive forces that may be transferred to the piston rod 224. FIG. 11 depicts components of the failsafe mechanism 226, including the spring 240, the cap 238, and the retainer 236. Also shown is a schematic representation of the piston rod 224. As shown, the spring 240 can be attached to the cap 238 at the first end 246 of the spring 240, and to the retainer 236 at second end 248 of the spring 240, so that as the retainer 236 moves toward or away from the piston rod 224, the spring 240 expands or compresses, respectively. When the retainer 236 moves away from the piston rod 224, as indicated by arrows A, the spring 240 compresses, and the amount of tensile force transferred to the piston rod 224 is reduced. Similarly, when the retainer 236 moves toward the piston rod 224, as indicated by arrows B, the amount of alternating stress within the piston rod 224 is reduced. Although a single spring 240 is shown, a plurality of the springs 240 may be used in the failsafe mechanism 226 if desired.

Figure 12:
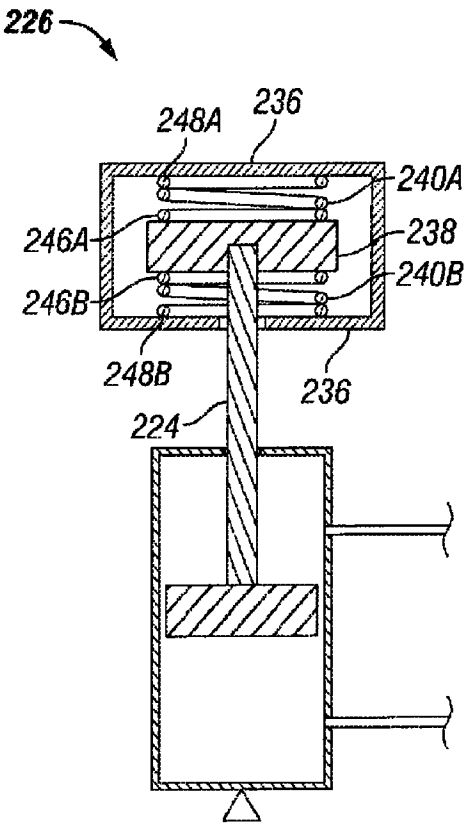
FIG. 12 is a schematic diagram depicting components of a hydraulic cylinder of an embodiment of the present technology.

In FIG. 12, there is shown a schematic depicting an alternate embodiment of the failsafe mechanism 226 acting to protect the piston rod 224 from both tensile and compressive forces that may be transferred to the piston rod 224. FIG. 12 depicts components of the failsafe mechanism 226, including a pair of springs 240A, 240B, the cap 238, and the retainer 236, which, in this embodiment, substantially surrounds the cap 236. Also shown is a schematic representation of the piston rod 224. As shown, the spring 240A can be attached to the cap 238 at the first end 246A of the spring 240A, and to the retainer 236 at the second end 248A of the spring 240A, so that as the retainer 236 moves toward the piston rod 224, the spring 240A compresses, thereby reducing the amount of compressive force transferred to the piston rod 224. Similarly, the spring 240B can be attached to the cap 238 at the first end 246B of the spring 240B, and to the retainer 236 at the second end 248B of the spring 240B, so that as the retainer 236 moves away from the piston rod 224, the spring 240B compresses, thereby reducing the amount of compressive force transferred to the piston rod 224. Again, although a single spring 240A, 240B is shown on each side of the cap 238, a plurality of springs 240A, 240B may be used on each side of the cap 238 if desired.

Figure 13A:
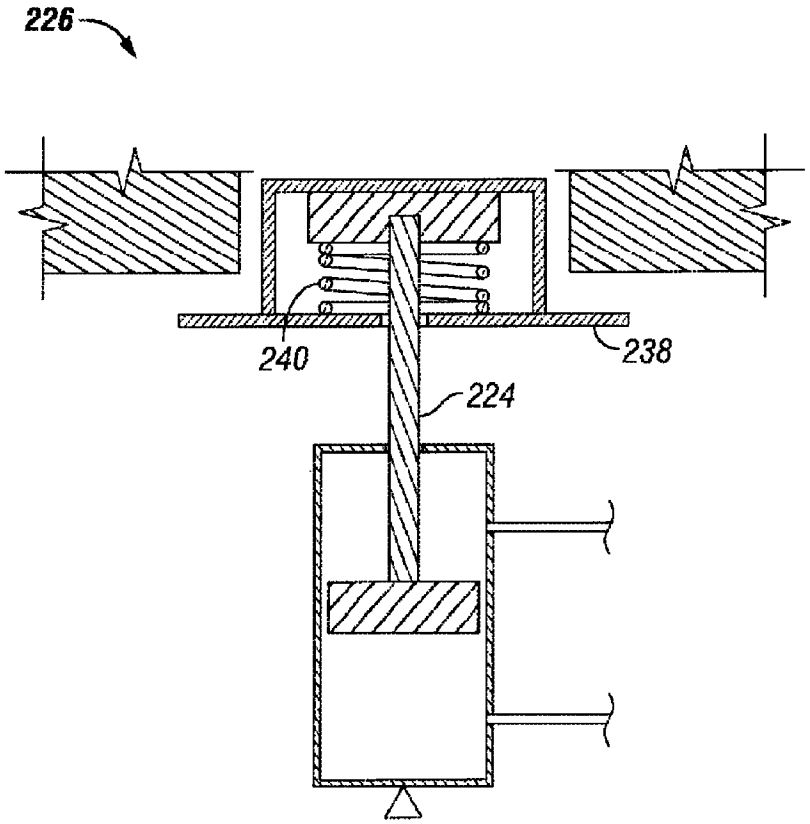
FIG. 13A is a schematic diagram depicting components of a hydraulic cylinder of an embodiment of the present technology.
Figure 13B:
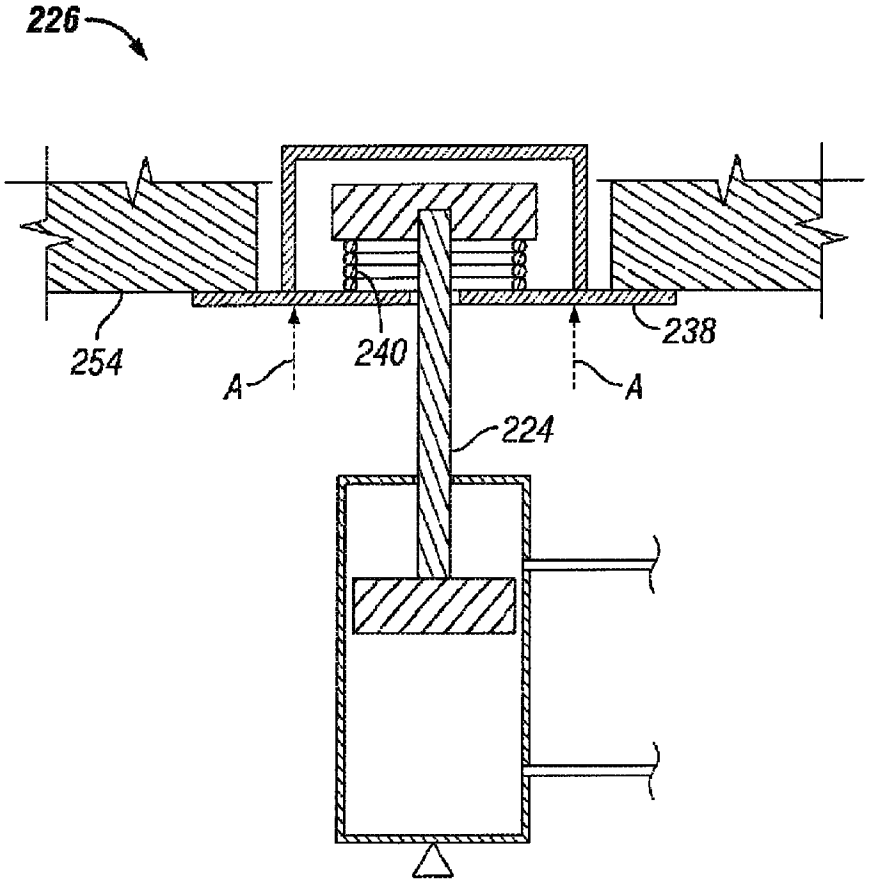
FIG. 13B is a schematic diagram depicting components of the hydraulic cylinder of FIG. 13A, wherein tension is applied to the hydraulic cylinder.

FIGS. 13A and 13B are schematic illustrations similar to the embodiment of FIG. 8, but further illustrating an embodiment where a stiffer geometry is encountered by the retainer 236 as the spring 240 compresses. Specifically, FIG. 13A depicts the piston rod 224 attached to the cap, and separated from the retainer by the spring 240, as in earlier described embodiments. When a force is applied to move the retainer away from the piston rod 224, the spring 240 compresses to reduce the load transfer from the retainer to the piston rod 224.

FIG. 13B depicts the force on the retainer acting in the direction of arrows A. As can be seen in FIG. 13B, after the spring 240 is compressed a predetermined amount, the retainer contacts a stiffer geometry 254, which impedes or limits further movement of the retainer away from the piston rod 224. When the retainer of FIG. 13B contacts the stiffer geometry 254, the load begins to transfer from the retainer to the stiffer geometry 254 so that the stiffness of the spring 240 becomes parallel to the stiffness of the contacted stiffer geometry 254. The added stiffness of the stiffer geometry 254 reduces the tension transferred to the piston rod 224.

While the present disclosure has been described with respect to a limited number of embodiments, those skilled in the art, having benefit of this disclosure, can appreciate that other embodiments may be devised which do not depart from the scope of the disclosure as described herein. Accordingly, the scope of the disclosure should be limited only by the attached claims.

What is claimed is:

1. A failsafe mechanism to reduce load of a hydraulic cylinder having a cylinder body, a stem at least partially circumscribed by the cylinder body and movable within the cylinder body, and a piston rod connected to the stem, the mechanism comprising:

a failsafe mechanism body fixedly attached to the cylinder body and defining a recess;

a retainer fixedly attached to the failsafe mechanism adjacent the opening of the recess so that the retainer substantially fills the opening of the recess, and having an aperture that receives an end of the piston rod;

a cap attached to the piston rod of the hydraulic cylinder within the recess in the failsafe mechanism body, the cap having a diameter greater than the diameter of the aperture in the retainer so that the cap is retained within the recess by the retainer; and a spring connected to the cap at a first end and to the retainer at a second end so that as the stem and piston rod move relative to the failsafe mechanism body, the spring compresses to reduce load transfer between the piston rod and the cylinder body.

2. The failsafe mechanism of claim 1, wherein the spring is substantially axially aligned with the stem circumscribed by the cylinder body.

3. The failsafe mechanism of claim 1, wherein the spring has a first side and a second side, and wherein the first side decompresses or extends as the second side compresses to prevent bending stress in the piston rod.

4. The failsafe mechanism of claim 1, wherein the spring is a plurality of springs, and wherein at least one of the plurality of springs is adapted to decompress or extend while at least one of the plurality of springs is adapted to compress.

5. The failsafe mechanism of claim 1, wherein the spring has a spring constant of at least about 8,000 pounds per inch.

6. The failsafe mechanism of claim 1, wherein the cap is configured for attachment to the piston rod by a threaded mechanism.

7. The failsafe mechanism of claim 1, wherein the failsafe mechanism is configured to be attached to the hydraulic cylinder with an attachment device.

8. The failsafe mechanism of claim 7, wherein the attachment device is a threaded interface.

9. A failsafe mechanism to reduce load of a hydraulic cylinder having a piston rod and a stem, the stem defining a recess adapted to receive the mechanism, the mechanism comprising:

a retainer fixedly attached to the stem of the hydraulic cylinder adjacent the opening of the recess so that the retainer substantially fills the opening of the recess, and having an aperture that receives an end of the piston rod;

a cap attached to the piston rod of the hydraulic cylinder within the recess in the stern, the cap having a diameter greater than the diameter of the aperture in the retainer so that the cap is retained within the recess by the retainer; and a spring connected to the cap at a first end and to the retainer at a second end so that as the stem and retainer move, the spring extends or compresses to reduce load transfer from the stem to the piston rod.

10. The failsafe mechanism of claim 9, wherein the spring is substantially axially aligned with the stem circumscribed by the cylinder body.

11. The failsafe mechanism of claim 9, wherein the spring has a first side and a second side, and wherein the first side decompresses or extends as the second side compresses to prevent bending stress in the piston rod.

12. The failsafe mechanism of claim 9, wherein the spring is a plurality of springs, and wherein at least one of the plurality of springs is adapted to decompress or extend while at least one of the plurality of springs is adapted to compress.

13. The failsafe mechanism of claim 9, wherein the spring is positioned between the piston rod and the stem and allows relative movement therebetween so that the load path is directed through a contact point of the hydraulic cylinder.

14. The failsafe mechanism of claim 9, wherein the spring has a spring constant of at least about 8,000 pounds per inch.

15. The failsafe mechanism of claim 9, wherein the cap is configured for attachment to the piston rod by a threaded mechanism.

16. The failsafe mechanism of claim 9, wherein the failsafe mechanism is configured to be attached to the hydraulic cylinder with an attachment device.

17. The failsafe mechanism of claim 16, wherein the attachment device is a threaded interface.

18. A method of reducing the transfer of a load a piston rod. and a cylinder body of a hydraulic cylinder, the method comprising the steps of:

providing a failsafe mechanism body defining a recess and fixedly attached to a cylinder body of a hydraulic cylinder, and a retainer fixedly attached to failsafe mechanism body adjacent the opening of the recess so that the retainer substantially fills the opening of the recess, the retainer having an aperture through the retainer into the recess;

retaining the end of the piston rod within the recess in a stern by attachment of a cap with a greater diameter than the aperture in the retainer to the piston rod within the recess; and damping the relative movement between the cylinder body and the piston rod with a spring attached at a first end to the cap and at a second end to the retainer, the spring adapted to compress as the stern moves to reduce load transfer between the cylinder body and the piston rod.

19. The method of claim 18, further comprising the step of:

damping the relative movement between the cylinder body and the piston rod with at least one additional spring attached at a first end to the cap and at a second end to the retainer, the at least one additional spring adapted to extend or compress as the stem moves to reduce load transfer from the stem to the piston rod.

20. The method of claim 18, further comprising:

using the failsafe mechanism to dampen relative movement between the cylinder body and the piston rod of a hydraulic connector in a subsea drilling operation.

* * * * *